US006281774B1

(12) United States Patent
Nishiuchi et al.

(10) Patent No.: US 6,281,774 B1
(45) Date of Patent: Aug. 28, 2001

(54) CORROSION-RESISTANT PERMANENT MAGNET AND METHOD FOR PRODUCING THE SAME

(75) Inventors: Takeshi Nishiuchi, Osaka; Kohshi Yoshimura, Hyogo; Fumiaki Kikui, Osaka, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/554,013

(22) PCT Filed: Sep. 10, 1999

(86) PCT No.: PCT/JP99/04915

§ 371 Date: May 9, 2000

§ 102(e) Date: May 9, 2000

(87) PCT Pub. No.: WO00/16347

PCT Pub. Date: Mar. 23, 2000

(51) Int. Cl.[7] ..... H01F 7/02; B05D 5/12

(52) U.S. Cl. ..... 335/302; 428/328; 428/336; 428/900; 427/127; 204/192.2; 148/101; 148/301

(58) Field of Search ..... 335/302; 428/323, 428/328, 329, 336, 900; 148/100, 101, 300, 301; 427/127, 216; 204/192.11, 192.2

(56) References Cited

U.S. PATENT DOCUMENTS 4,935,080 * 6/1990 Hassell et al. ..... 156/154
5,013,411 * 5/1991 Minowa et al. ..... 204/29
5,302,464 * 4/1994 Nomura et al. ..... 428/551
5,316,595 * 5/1994 Hamada et al. ..... 148/302
5,348,639 * 9/1994 Mitsuji ..... 205/181

FOREIGN PATENT DOCUMENTS 4-180576 * 6/1992 (JP) .
7-249509 * 9/1995 (JP) .

* cited by examiner

*Primary Examiner*—Ramon M. Barrera
(74) *Attorney, Agent, or Firm*—Armstrong, Westerman, Hattori, McLeland & Naughton, LLP

(57) ABSTRACT

The present invention provides an Fe—B—R based permanent magnet, which has a chemical conversion coating film formed on its surface with an aluminum film interposed therebetween, the chemical conversion coating film containing at least one of titanium and zirconium, phosphorus, oxygen and fluorine as constituting elements, and a process for producing such an Fe—B—R based permanent magnet. In the permanent magnet, the chemical conversion coating film is adhered firmly to the magnet with the aluminum film interposed therebetween and hence, the magnet is excellent in corrosion resistance. Even if the magnet is left to stand for a long time under high-temperature and high-humidity conditions of a temperature of 80° C. and a relative humidity of 90%, the magnet exhibits a stable high magnetic characteristic which cannot deteriorate. Moreover, the film is free from hexa-valent chromium.

15 Claims, No Drawings

CORROSION-RESISTANT PERMANENT MAGNET AND METHOD FOR PRODUCING THE SAME

TECHNICAL FIELD

The present invention relates to an Fe—B—R based permanent magnet having an excellent corrosion-resistant film, and to a process for producing the same. More particularly, the present invention relates to an Fe—B—R based permanent magnet which has, on the surface thereof, a corrosion-resistant film having an excellent adhesion to the magnet, and which can exhibit a stable high magnetic characteristic that cannot deteriorate even if the magnet is left to stand for a long time under high-temperature and high-humidity conditions of a temperature of 80° C. and a relative humidity of 90%; and in which the film is free from hexa-valent chromium, and to a process for producing the same.

BACKGROUND ART

An Fe—B—R based permanent magnet, of which an Fe—B—Nd based permanent magnet is representative, is practically used in various applications, because it is produced from an inexpensive material rich in natural resources and has a high magnetic characteristic, as compared with an Sm—Co based permanent magnet.

However, the Fe—B—R based permanent magnet is liable to be corroded by oxidation in the atmosphere, because it contains highly reactive R and Fe. When the Fe—B—R based permanent magnet is used without being subjected to any surface treatment, the corrosion of the magnet is advanced from its surface due to the presence of a small amount of acid, alkali and/or water to produce rust, thereby bringing about the degradation and dispersion of the magnetic characteristic. Further, when the magnet having the rust produced therein is incorporated into a device such as a magnetic circuit, there is a possibility that the rust is scattered to pollute surrounding parts or components.

There is an already proposed magnet which has a corrosion-resistant metal-plated film on its surface, which is formed by a wet plating process such as an electro-less plating process and an electroplating process, in order to improve the corrosion resistance of the Fe—B—R based permanent magnet with the above-described point in view (see Japanese Patent Publication No.3-74012). In this process, however, an acidic or alkaline solution used in a pretreatment prior to the plating treatment may remain in pores on the magnet, whereby the magnet may be corroded with the passage of time in some cases. In addition, the magnet is poor in resistance to chemicals and for this reason, the surface of the magnet may be corroded during the plating treatment. Further, even if the metal-plated film is formed on the surface of the magnet, as described above, if the magnet is subjected to a corrosion resistance test under conditions of a temperature of 60° C. and a relative humidity of 90%, the magnetic characteristic of the magnet may be degraded by 10% or more from an initial value after lapse of 100 hours.

There is also a conventionally proposed process in which an oxidation-resistant chemical conversion coating film such as a phosphate film or a chromate film is formed on the surface of an Fe—B—R based permanent magnet (see Japanese Patent Publication No.4-22008). The film formed in this process is excellent in adhesion to the magnet, but if it is subjected to a corrosion resistance test under conditions of a temperature of 60° C. and a relative humidity of 90%, the magnetic characteristic of the magnet may be degraded by 10% or more from an initial value after lapse of 300 hours.

A process which has been conventionally proposed in order to improve the corrosion resistance of the Fe—B—R based permanent magnet, and in which a chromate treatment is carried out after the formation of an aluminum film by a vapor deposition process, i.e., a so-called aluminum-chromate treating process (see Japanese Patent Publication No.6-66173), is intended to improve the corrosion resistance of the magnet remarkably. However, the chromate treatment used in this process uses hexa-valent chromium which is undesirable for the environment and for this reason, a waste-liquid treating method is complicated. It is feared that a film formed in this process affects a human body during handling of the magnet, because it contains just a small amount of hexa-valent chromium.

Accordingly, it is an object of the present invention to provide an Fe—B—R based permanent magnet which has, on the surface thereof, a corrosion-resistant film having an excellent adhesion to the magnet, and which can exhibit a stable high magnetic characteristic that cannot deteriorate even if the magnet is left to stand for a long time under high-temperature and high-humidity conditions of a temperature of 80° C. and a relative humidity of 90%, and in which the film is free from hexa-valent chromium, and a process for producing the same.

DISCLOSURE OF THE INVENTION

The present inventors, as a result of various zealous studies made with the above points in view, have found that if an aluminum film is formed on the surface of an Fe—B—R based permanent magnet, and a chemical conversion coating film containing titanium and/or zirconium as constituting elements is formed on the aluminum film, the chemical conversion coating film is firmly adhered onto the magnet with the aluminum film interposed therebetween, thereby exhibiting an excellent corrosion resistance.

The present invention has been accomplished with the above knowledge, and according to claim 1 of the present invention, there is provided an Fe—B—R based permanent magnet, which has a chemical conversion coating film formed on its surface with an aluminum film interposed therebetween, the chemical conversion coating film containing at least one of titanium and zirconium, phosphorus, oxygen and fluorine as constituting elements.

According to claim 2 of the present invention, in addition to claim 1, the aluminum film has a thickness in a range of 0.01 $\mu$m to 50 $\mu$m.

According to claim 3 of the present invention, in addition to claim 1, the chemical conversion coating film has a thickness in a range of 0.01 $\mu$m to 1 $\mu$m.

According to claim 4 of the present invention, in addition to claim 1, the content of titanium and/or zirconium in the chemical conversion coating film is in a range of 0.1 mg to 100 mg per a film portion formed on 1 $m^2$ of the surface of the magnet.

According to claim 5 of the present invention, in addition to claim 1, the content of phosphorus in the chemical conversion coating film is in a range of 0.1 mg to 100 mg per a film portion formed on 1 $m^2$ of the surface of the magnet.

According to claim 6 of the present invention, in addition to claim 1, the content of oxygen in the chemical conversion coating film is in a range of 0.2 mg to 300 mg per a film portion formed on 1 $m^2$ of the surface of the magnet.

According to claim 7 of the present invention, in addition to claim 1, the content of fluorine in the chemical conversion coating film is in a range of 0.05 mg to 100 mg per a film portion formed on 1 $m^2$ of the surface of the magnet.

According to claim 8 of the present invention, in addition to claim 1, the ratio of the number of moles of phosphorus to the number of moles of titanium and/or zirconium in an area near the surface of the chemical conversion coating film is larger than that in the entire chemical conversion coating film.

According to claim 9 of the present invention, in addition to claim 1, the ratio of the number of moles of phosphorus to the number of moles of titanium and/or zirconium in an area near the surface of the chemical conversion coating film is equal to or larger than 1.

According to claim 10 of the present invention, there is provided a process for producing an Fe—B—R based permanent magnet, comprising the steps of forming an aluminum film on the surface of an Fe—B—R based permanent magnet, applying a treating solution containing at least one of a titanium compound and a zirconium compound, at least one of phosphoric acid, condensed phosphoric acid, phytic acid, the hydrolyzate of phytic acid and the salts of them, and a fluorine compound, onto the surface of the aluminum film, and drying the applied treating solution, thereby forming a chemical conversion coating film containing at least one of titanium and zirconium, phosphorus, oxygen and fluorine as constituting elements.

According to claim 11 of the present invention, in addition to claim 10, the aluminum film is formed by a vapor deposition process.

According to claim 12 of the present invention, in addition to claim 11, the aluminum film has a thickness in a range of 0.01 $\mu$m to 50 $\mu$m.

According to claim 13 of the present invention, in addition to claim 10, the Fe—B—R based permanent magnet and aluminum pieces are placed into a treating vessel, where they are vibrated and/or agitated, thereby forming the aluminum film.

According to claim 14 of the present invention, in addition to claim 13, the aluminum film has a thickness in a range of 0.01 $\mu$m to 1 $\mu$m.

According to claim 15 of the present invention, in addition to claim 10, the ratio of the number of moles (in terms of phosphorus) of at least one of phosphoric acid, condensed phosphoric acid, phytic acid, the hydrolyzate of phytic acid and the salts of them to the number of moles (in terms of metal) of at least one of the titanium compound and the zirconium compound in the treating solution is equal to or larger than 1.

BEST MODE FOR CARRYING OUT THE INVENTION

An Fe—B—R based permanent magnet according to the present invention has a feature that it has a chemical conversion coating film which is formed on its surface with an aluminum film interposed therebetween, and which contains at least one of titanium and zirconium, phosphorus, oxygen and fluorine as constituting elements.

The method for forming the aluminum film on the surface of the Fe—B—R based permanent magnet is particularly not limited. However, if it is taken into consideration that the magnet and the aluminum film are liable to be corroded by oxidation, examples of a desirable process are a process utilizing a vapor deposition process, and a process which comprises placing an Fe—B—R based permanent magnet and aluminum pieces into a treating vessel, where they are vibrated and/or agitated.

(1) Process Utilizing Vapor Deposition Process

Examples of the vapor deposition process are known processes such as a vacuum evaporation process, an ion sputtering process, an ion plating process and the like. The aluminum film may be formed under common conditions in each of the processes, but from the viewpoints of the denseness, the uniformity in thickness, the forming speed of the film to be formed and the like, it is desirable that the vacuum evaporation process and the ion plating process are employed. Of course, the surface of the magnet may be subjected to a known cleaning treatment such as a washing, a degreasing treatment and a sputtering, prior to the formation of the film.

It is desirable that the temperature of the magnet during the formation of the film is set in a range of 200° C. to 500° C. If the temperature is lower than 200° C., there is a possibility that a film having an excellent adhesion to the surface of the magnet is not formed. On the other hand, if the temperature exceeds 500° C., there is a possibility that cracks are produced in the film, thereby causing the film to be peeled off from the magnet, in a cooling course after the formation of the film.

It is desirable that the thickness of the aluminum film is in a range of 0.01 $\mu$m to 50 $\mu$m, more preferably, in a range of 0.05 $\mu$m to 25 $\mu$m. If the thickness is smaller than 0.01 $\mu$m, there is a possibility that the film cannot exhibit an excellent corrosion resistance. If the thickness exceeds 50 $\mu$m, there is a possibility that an increase in manufacture cost is brought about, but also, there is a possibility that the effective volume of the magnet is decreased.

(2) Process Comprising the Placing of Fe—B—R Based Permanent Magnet and Aluminum Pieces into Treating Vessel, where They are Vibrated and/or Agitated.

The aluminum pieces used in this process may be of any of various shapes such as a needle-like shape (a wire-like shape), a columnar shape and a massive shape. However, from the viewpoint of efficient production of a fine aluminum powder serving as a source for formation of an aluminum film, it is desirable that aluminum pieces having a needle-like shape with sharp terminal ends or a columnar shape with sharp terminal ends is used.

It is desirable from the viewpoint of efficient production of a fine aluminum powder that the size (longer diameter) of the aluminum pieces is in a range of 0.05 mm to 10 mm, more preferably in a range of 0.3 mm to 5 mm, further preferably in a range of 0.5 mm to 3 mm. Aluminum pieces having the same shape and the same size may be used, but aluminum pieces having different shapes and different sizes may be used in the form of a mixture.

It is desirable that the vibration and/or agitation of the magnet and the aluminum pieces is carried out in a dry manner in consideration of the fact that they are liable to be corroded by oxidation. The vibration and/or agitation of the magnet and the aluminum pieces can be carried out in the atmosphere and at ambient temperature. It is unnecessary to employ a complicated apparatus for the treating vessel used in the present invention, and for example, the treating vessel may be a treating chamber in a barrel finishing machine. The barrel finishing machine may be of any known type such as a rotated-type, a vibrated-type and a centrifugal-type. In the case of the rotated-type, the rotational speed is desirable to be in a range of 20 rpm to 50 rpm. In the case of the vibrated-type, it is desirable that the vibration frequency is in a range of 50 Hz to 100 Hz, and the vibration amplitude is in a range of 0.3 mm to 10 mm. In the case of the centrifugal-type, the rotational speed is desirable to be in a range of 70 rpm to 200 rpm.

It is desirable that the total amount of the magnet and the aluminum pieces placed into the treating vessel is in a range of 20% to 90% by volume of the internal volume of the treating vessel. If the total amount is smaller than 20% by volume, the throughput is too small, which is not preferable in practical use. If the total amount exceeds 90% by volume, there is a possibility that the film cannot be formed efficiently. It is desirable that the ratio of the amount of the magnet to the amount of the aluminum pieces placed into the treating vessel is equal to or smaller than 3 in terms of a volume ratio (of magnet/aluminum pieces). If the volume ratio exceeds 3, there is a possibility that a long time is required for the formation of the film, which is not preferred in practical use. The treating time depends on the throughput, but is usually in a range of 1 to 10 hours.

According to the above-described process, a fine aluminum powder produced from the aluminum pieces is adhered to the surface of the magnet to form the aluminum film. It is considered that the phenomenon of the adhesion of the fine aluminum powder to the surface of the magnet is a kind of a mechanochemical reaction. The fine aluminum powder is adhered firmly to the surface of the magnet, and the formed aluminum film exhibits an excellent corrosion resistance. From the viewpoint of ensuring a sufficient corrosion resistance, it is desirable that the thickness of the film is equal to or larger than 0.01 $\mu$m, as described above. The upper limit for the thickness is particularly not limited, but if the thickness exceeds 1 $\mu$m, a long time is required for forming the aluminum film. For this reason, this process is suitable to form an aluminum film having a thickness equal to or smaller than 1 $\mu$m.

After the formation of the aluminum film on the surface of the magnet, the aluminum film can be subjected to a heat treatment to enhance the adhesion of the aluminum film to the surface of the magnet. The temperature in the heat treatment is desirable to be in a range of 200° C. to 500° C., and more desirable to be in a range of 200° C. to 250° C. from the viewpoints of productivity and manufacture cost. If the temperature is lower than 200° C., there is a possibility that an interfacial reaction of the aluminum film with the magnet is not advanced sufficiently, and as a result, the adhesion is not enhanced. If the temperature exceeds 500° C., there is a possibility that the deterioration of the magnetic characteristic of the magnet is brought about and that the aluminum film is melted.

A process for forming a chemical conversion coating film containing at least one of titanium and zirconium, phosphorus, oxygen and fluorine as constituting elements on the aluminum film will be described below. One example of this process is a process which comprises applying, to the surface of the aluminum film, a treating solution containing at least one of a titanium compound and a zirconium compound, at least one of phosphoric acid, condensed phosphoric acid, phytic acid, the hydrolyzate of phytic acid and the salts of them, and a fluorine compound, and subjecting the applied solution to a drying treatment.

The treating solution is prepared by dissolving, into water, at least one of the titanium compound and the zirconium compound, at least one of phosphoric acid, condensed phosphoric acid, phytic acid, the hydrolyzate of phytic acid and the salts of them, and the fluorine compound.

Examples of the titanium compound contained in the treating solution, which may be used, are fluorotitanic acid, alkali metal, alkaline earth metal and ammonium fluorotitanates, titanium sulfate and nitrate and the like. Examples of the zirconium compound which may be used are fluorozirconic acid, alkali metal, alkaline earth metal and ammonium fluorozirconates, zirconium sulfate and nitrate and the like. It is desirable that the content of at least one of the titanium compound and zirconium compound in the treating solution is in a range of 1 ppm to 2,000 ppm, more preferably, in a range of 10 ppm to 1,000 ppm in terms of metal. If the content is smaller than 1 ppm, there is a possibility that the chemical conversion coating film is not formed. If the content is larger than 2,000 ppm, there is a possibility that an increase in cost is brought about.

Examples of condensed phosphoric acid contained in the treating solution, which may be used, are pyrophosphoric acid, tripolyphosphoric acid, metaphosphoric acid, ultraphosphoric acid and the like. Examples of the hydrolyzate of phytic acid, which may be used, are myo-inositol diphosphate, triphosphate, tetraphosphate and pentaphosphate and the like. Examples of the salts of phosphoric acid, condensed phosphoric acid, phytic acid and the hydrolyzate of phytic acid, which may be used, are ammonium, alkali metal and alkaline earth metal salts of phosphoric acid, condensed phosphoric acid, phytic acid and the hydrolyzate of phytic acid. When any of phosphoric acid, condensed phosphoric acid and the salts thereof is used, it is desirable that the content thereof in the treating solution is in a range of 1 ppm to 2,000 ppm, more preferably, in a range of 5 ppm to 1,000 ppm in terms of phosphoric acid. The reason is as follows: if the content is smaller than 1 ppm, there is a possibility that a chemical conversion coating film is not formed. If the content is larger than 2,000 ppm, the adhesion of a chemical conversion coating film to the magnet is influenced. When any one of phytic acid, the hydrolyzate of phytic acid and the salts thereof is used, it is desirable for a similar reason that the content thereof in the treating solution is in a range of 50 ppm to 10,000 ppm, more preferably, in a range of 100 ppm to 5,000 ppm in terms of phytic acid.

Examples of the fluorine compound contained in the treating solution, which may be used, are hydrofluoric acid, ammonium fluoride, ammonium hydrogen fluoride, sodium fluoride and sodium hydrogen fluoride and the like, in addition to the above-described fluorotitanic acid and the salt thereof, and fluorozirconic acid and the salt thereof. It is desirable that the content of the fluorine compound in the treating solution is in a range of 10 ppm to 10,000 ppm, more preferably, in a range of 50 ppm to 5,000 ppm. If the content is smaller than 10 ppm, there is a possibility that the surface of the aluminum film is not etched efficiently. If the content is larger than 10,000 ppm, there is a possibility that the etching speed is higher than the film forming speed, thereby making it difficult to form a film uniformly.

It is desirable that the pH value of the treating solution is regulated to a range of 1 to 6. If the pH value is smaller than 1, there is a possibility that the surface of the aluminum film is etched excessively. If the pH value exceeds 6, there is a possibility that the stability of the treating solution is influenced.

In addition to the above-described constituents, an organic acid such as tannic acid, an oxidizing agent (hydrogen peroxide, chloric acid and the salts thereof, nitrous acid and the salt thereof, nitric acid and the salt thereof, tungstic acid and the salt thereof, and molybdic acid and the salt thereof), and a water-soluble resin such as a water-soluble polyamide, may be added to the treating solution for the purpose of enhancing the chemically converting reaction, the stability of the treating solution, the adhesion of a chemical conversion coating film to the magnet and the adhesion to an adhesive used for incorporating the magnet into parts.

When the treating solution itself is poor in shelf stability, the treating solution may be prepared as required. Examples of the treating solution, which may be used in the present invention, are a treating solution prepared from PALCOAT 3753 (which is a trade name and made by Nihon Parkerizing Co., Ltd.), and a treating solution prepared from PALCOAT 3756MA and PALCOAT 3756MB (both of which are trade names and made by Nihon Parkerizing Co., Ltd.).

Examples of the method for applying the treating solution to the surface of the aluminum film, which may be used, are a dip coating process, a spraying process and a spin coating process. It is desirable that the temperature of the treating solution when being applied is set in a range of 20° C. to 80° C. If the temperature is lower than 20° C., there is a possibility that the reaction is not advanced. If the temperature exceeds 80° C., there is a possibility that the stability of the treating solution is influenced. The treating time is usually in a range of 10 seconds to 10 minutes.

After application of the treating solution to the surface of the aluminum film, the applied treating solution is subjected to a drying treatment. The temperature in the drying treatment is desirable to be in a range of 50° C. to 250° C., and more desirable to be in a range of 50° C. to 150° C. from the viewpoints of the productivity and manufacture cost. The reason is as follows: If the temperature is lower than 50° C., the treating solution cannot be dried sufficiently and as a result, there is a possibility that the deterioration of the appearance is brought about, and that the adhesion to an adhesive used for incorporating the magnet into parts is influenced. If the temperature exceeds 250° C., there is a possibility that the decomposition of the chemical conversion coating film occurs. The treating time is usually in a range of 5 seconds to 1 hour.

The chemical conversion coating film formed by the above-described process and containing at least one of titanium and zirconium, phosphorus, oxygen and fluorine as constituting elements is adhered firmly to the surface of the magnet with the aluminum film interposed therebetween. Therefore, if the thickness of the chemical conversion coating film is equal to or larger than 0.01 $\mu$m, a sufficient corrosion resistance is provided. It is believed that during the chemically converting treatment, phosphoric acid or condensed phosphoric acid in the treating solution reacts with Nd or Fe which is a magnet material on the surface of the magnet, thereby forming a passive film, and hence, even if the aluminum film has a portion which has been formed unsatisfactorily, the passive film compensates for the corrosion resistance of such portion. Although the upper limit of the thickness of the chemical conversion coating film is not limited, the thickness of the chemical conversion coating film is desirable to be equal to or smaller than 1 $\mu$m and more desirable to be equal to or smaller than 0.3 $\mu$m from the viewpoints of the need for reduction in size of the magnet itself and the manufacture cost.

The content of titanium and/or zirconium in the chemical conversion coating film is desirable to be in a range of 0.1 mg to 100 mg and more desirable to be in a range of 1 mg to 50 mg per a film portion formed on 1 $m^2$ of the surface of the magnet. If the content is smaller than 0.1 mg, there is a possibility that a sufficient corrosion resistance is not provided. If the content is larger than 100 mg, there is a possibility that an increase in cost is brought about.

The content of phosphorus in the chemical conversion coating film is desirable to be in a range of 0.1 mg to 100 mg and more desirable to be in a range of 1 mg to 50 mg per a film portion formed on 1 $m^2$ of the surface of the magnet. If the content is smaller than 0.1 mg, there is a possibility that a sufficient corrosion resistance is not provided. If the content is larger than 100 mg, there is a possibility that the adhesion to an adhesive used for incorporating the magnet into parts is influenced.

Oxygen in the chemical conversion coating film is present in the chemical conversion coating film in the form bonded to titanium, zirconium or phosphorus, and as a constituting element of the organic acid added into the treating solution for the purpose of enhancing the adhesion to an adhesive used for incorporating the magnet into the parts. It is desirable that the content of oxygen in the chemical conversion coating film is in a range of 0.2 mg to 300 mg per a film portion formed on 1 $m^2$ of the surface of the magnet. If the content is smaller than 0.2 mg, there is a possibility that a sufficient corrosion resistance is not provided. If the content is larger than 300 mg, there is a possibility that the adhesion to an adhesive used for incorporating the magnet into the parts is influenced.

Fluorine in the chemical conversion coating film is incorporated into the chemical conversion coating film upon the formation of the chemical conversion coating film due to free fluorine ion or fluorine bonding with the Zr compound such as $ZrF_4HPO_4$ present in the treating solution for the purpose of etching the surface of the aluminum film. The content of fluorine in the chemical conversion coating film is desirable to be in a range of 0.05 mg to 100 mg and more desirable to be in a range of 0.1 mg to 50 mg per a film portion formed on 1 $m^2$of the surface of the magnet. If the content is smaller than 0.05 mg, there is a possibility that a sufficient corrosion resistance is not provided. If the content is larger than 100 mg, there is a possibility that the adhesion to an adhesive used for incorporating the magnet into the parts is influenced.

Preferred among the chemical conversion coating films formed by the above-described process and containing at least one of titanium and zirconium, phosphorus, oxygen and fluorine as constituting elements, are a film in which the ratio of the number of moles of phosphorus to the number of moles of titanium and/or zirconium in an area near the surface of the film (e.g., an area between the surface of the film and a point 0.002 $\mu$m spaced apart from the surface of the film) is larger than that in the entire film, and a film in which the ratio of the number of moles of phosphorus to the number of moles of titanium and/or zirconium in an area near the surface of the film is equal to or larger than 1, desirably, equal to or larger than 2 and more desirably, equal to or larger than 3. The reason is believed to be that even if the film is brought into contact with water, a large number of molecules of phosphoric acid or condensed phosphoric acid present in the area near the surface of the film catch the water, thereby preventing the water causing the corrosion from reaching the surface of the magnet. To form such a film, it is desirable to use a treating solution in which the ratio of the number of moles (in terms of phosphorus) of at least one of phosphoric acid, condensed phosphoric acid, phytic acid, the hydrolyzate of phytic acid and their salts to the number of moles (in terms of metal) of at least one of the titanium compound and the zirconium compound in the treating solution is equal to or larger than 1.

Prior to the formation of a chemical conversion coating film on the aluminum film, a shot peening (a method for modifying a surface by bumping hard grains against the surface) may be carried out as a previous step. The shot peening enables the aluminum film to be smoothened, thereby facilitating the formation of a chemical conversion coating film which is thin, but has an excellent corrosion resistance.

A powder used for the shot peening is desirable to have a hardness equivalent to or higher that of the formed aluminum film, and examples of the powder are spherical hard materials having a Mohs hardness of 3 or more such as those comprising steel balls and glass beads. The average particle size of the powder is desirable to be in a range of 30 $\mu$m to 3,000 $\mu$m and more desirable to be in a range of 40 $\mu$m to 2,000 $\mu$m. If the average particle size is smaller than 30 $\mu$m, the pressing force applied to the aluminum film is small, resulting in a long time taken for the treatment. On the other hand, if the average particle size exceeds 3,000 $\mu$m there is a possibility that the roughness of the treated surface is too large, and the finished surface is uneven.

The injection pressure in the shot peening is desirable to be in a range of 1.0 kg/cm$^2$ to 5.0 kg/cm$^2$. If the injection pressure is lower than 1.0 kg/cm$^2$, the pressing force to the metallic film is small, resulting in a long time taken for the treatment. If the injection pressure exceeds 5.0 kg/cm$^2$, there is a possibility that the pressing force to the metallic film is ununiform, thereby bringing about the deterioration of the roughness of the surface.

The injection time in the shot peening is desirable to be in a range of 1 minute to 1 hour. If the injection time is shorter than 1 minute, there is a possibility that the entire surface cannot be treated uniformly. If the injection time exceeds 1 hour, there is a possibility that the deterioration of the roughness of the surface is brought about.

A rare earth element (R) contained in an Fe—B—R based permanent magnet used in the present invention is desirably at least one of Nd, Pr, Dy, Ho, Tb and Sm, in addition thereto at least one of La, Ce, Gd, Er, Eu, Tm, Yb, Lu and Y.

Usually, one of them (R) suffices, but in practice, a mixture of two or more rare earth elements (misch metal and didymium and the like) may be used for the reason of an available convenience.

The content of R in the Fe—B—R based permanent magnet is desirable to be in a range of 10% by atom to 30% by atom. If the R content is lower than 10% by atom, the crystal structure is the same cubic crystal structure as $\alpha$-Fe and for this reason, a high magnetic characteristic, particularly, a high coercive force (iHc) is not obtained. On the other hand, if the R content exceeds 30% by atom, the content of an R-rich non-magnetic phase is increased, and the residual magnetic flux density (Br) is reduced, whereby a permanent magnet having an excellent characteristic is not produced.

The Fe content is desirable to be in a range of 65% by atom to 80% by atom. If the Fe content is lower than 65% by atom, the residual magnetic flux density (Br) is reduced. If the Fe content exceeds 80% by atom, a high coercive force (iHc) is not obtained.

It is possible to improve the temperature characteristic without degradation of the magnetic characteristic of the produced magnet by substituting a portion of Fe with Co. However, if the amount of Co substituted exceeds 20% of Fe, the magnetic characteristic is degraded and hence, such amount is not preferred. The amount of Co substituted in a range of 5% by atom to 15% by atom is desirable for providing a high magnetic flux density, because the residual magnetic flux density (Br) is increased, as compared with a case where a portion of Fe is not substituted.

The B content is desirable to be in a range of 2% by atom to 28% by atom. If the B content is lower than 2% by atom, a rhombohedral structure is a main phase, and a high coercive force (iHc) is not obtained. If the B content exceeds 28% by atom, the content of a B-rich non-magnetic phase is increased, and the residual magnetic flux density (Br) is reduced, whereby a permanent magnet having an excellent characteristic is not produced.

To improve the manufacture of the magnet and reduce the cost, at least one of 2.0% by weight or less of P and 2.0% by weight or less of S may be contained in a total amount of 2.0% by weight or less. Further, the corrosion resistance of the magnet can be improved by substituting a portion of B with 30% by weight or less of carbon (C).

Further, the addition of at least one of Al, Ti, V, Cr, Mn, Bi, Nb, Ta, Mo, W, Sb, Ge, Sn, Zr, Ni, Si, Zn, Hf and Ga is effective for improving the coercive force and the rectangularity of a demagnetizing curve and for improving the manufacture and reducing the cost. It is desirable that at least one of them is added in an amount within a range satisfying a condition that at least 9 kG of Br is required in order to ensure that the maximum energy product (BH)max is equal to or larger than 20 MGOe.

In addition to R, Fe and B, the Fe—B—R based permanent magnet may contain impurities inevitable for industrial production of the magnet.

The Fe—B—R based permanent magnet used in the present invention has a feature in that it includes a main phase comprising a compound having a tetragonal crystal structure with an average crystal grain size in a range of 1 $\mu$m to 80 $\mu$m, and 1% to 50% by volume of a non-magnetic phase (excluding an oxide phase). This magnet shows iHc$\geqq$1 kOe, Br>4 kG and (BH)max$\geqq$10 MGOe, wherein the maximum value of (BH)max reaches 25 MGOe or more.

A further film may be formed on the chemical conversion coating film of the present invention. By employing such a configuration, it is possible to enhance the characteristic of the chemical conversion coating film and provide a further functionability to the chemical conversion coating film.

EXAMPLES

For example, as described in U.S. Pat. No. 4,770,723, a known cast ingot was pulverized and then subjected sequentially to a pressing, a sintering, a heat treatment and a surface working, thereby producing a sintered magnet having a size of 23 mm×10 mm×6 mm and a composition of 17Nd-1Pr-75Fe-7B (which will be referred to as "magnet test piece" hereinafter). The magnet test piece was subjected to the following experiment, wherein the thickness of an aluminum film was measured using a fluorescence X-ray thickness-meter (SFT-7000 made by Seiko Instruments and Electronics, Ltd.). The thickness of a chemical conversion coating film was determined by an analysis in a direction of the depth of the film using an X-ray photoelectron spectroscopy (XPS) (using ESCA-850 made by Shimadzu, Co.). The content of each of the constituents in the film was measured by a fluorescence X-ray intensity (using RIX-3000 made by Rigaku Corporation, Co.).

It should be noted that the present invention is applicable not only to an Fe—B—R based sintered magnet but also to an Fe—B—R based bonded magnet.

Example 1

A magnet test piece was subjected to a sputtering in an evacuated vacuum vessel evacuated to $1\times10^{-4}$ Pa for 35 minutes under conditions of an argon gas pressure of 10 Pa and a bias voltage of −400 V, and the surface of the magnet was cleaned.

Then, the magnet test piece was subjected to an arc ion plating process for 15 minutes with metal aluminum used as a target under conditions of an argon gas pressure of 0.2 Pa, a bias voltage of −50 V and a magnet temperature of 250° C., whereby an aluminum film was formed on the surface of the magnet and left to cool. The formed aluminum film had a thickness of 0.5 μm.

35 g of PALCOAT 3753 (which is a trade name and made by Nihon Parkerizing Co., Ltd.) was dissolved in 1 liter of water to produce a treating solution (having a pH value of 3.8). The magnet having the aluminum film on its surface was dipped in this treating solution at a bath temperature of 40° C. for 1 minute and then subjected to a drying treatment at 100° C. for 20 minutes, whereby a titanium-containing chemical conversion coating film having a thickness of 0.1 μm was formed on the aluminum film. The content of titanium in the chemical conversion coating film was 10 mg (per 1 $m^2$ of the surface of the magnet); the content of phosphorus was 7 mg (per 1 $m^2$ of the surface of the magnet); the content of oxygen was 21 mg (per 1 $m^2$ of the surface of the magnet), and the content of fluorine was 2 mg (per 1 $m^2$ of the surface of the magnet).

The magnet produced in the above-described manner and having the titanium-containing chemical conversion coating film on its surface with the aluminum film interposed therebetween was subjected to a corrosion resistance acceleration test, wherein it was left to stand for 300 hours under high-temperature and high-humidity conditions of a temperature of 80° C. and a relative humidity of 90%. The magnetic characteristics before and after the test and the state of variation in appearance after the test are shown in Table 1. As a result, it was found that even if the magnet was left to stand for a long time under the high-temperature and high-humidity conditions, the magnet satisfied a required corrosion resistance sufficiently with both of the magnetic characteristic and appearance little degraded.

Example 2

The magnet test piece was cleaned under the same conditions as in Example 1. Then, an aluminum (Al) wire used as a coating material was heated, evaporated and ionized for an ion plating process for 1 minute under conditions of an argon gas pressure of 1 Pa and a voltage of 1.5 kV, thereby forming an aluminum film on the surface of the magnet, and the film was left to cool. The formed aluminum film had a thickness of 0.9 μm.

Thereafter, a powder comprising spherical glass beads having an average particle size of 120 μm and a Mohs hardness of 6 was injected along with a pressurized gas comprising $N_2$ gas against the surface of the aluminum film under an injection pressure of 1.5 kg/$cm^2$ for 5 minutes to carry out the shot peening of the surface of the aluminum film.

10 g of PALCOAT 3756MA and 10 g of PALCOAT 3756MB (both of which are trade names and made by Nihon Parkerizing Co., Ltd.) were dissolved in 1 liter of water to produce a treating solution (in which the ratio of the number of moles of phosphorus to the number of moles of zirconium was 6.2, and which had a pH value of 3.2). The magnet having the aluminum film on its surface was dipped in this treating solution at a bath temperature of 50° C. for 1 minute and 30 seconds and then subjected to a drying treatment at 120° C. for 20minutes, whereby a zirconium-containing chemical conversion coating film having a thickness of 0.07 μm was formed on the aluminum film. The content of zirconium in the chemical conversion coating film was 16 mg (per 1 $m^2$ of the surface of the magnet); the content of phosphorus was 11 mg (per 1 $m^2$ of the surface of the magnet); the content of oxygen was 50 mg (per 1 $m^2$ of the surface of the magnet), and the content of fluorine was 3 mg (per 1 $m^2$ of the surface of the magnet).

The magnet produced in the above-described manner and having the zirconium-containing chemical conversion coating film on its surface with the aluminum film interposed therebetween was subjected to the corrosion resistance acceleration test under the same conditions as in Example 1. Results of the test are shown in Table 1. As a result, it was found that the produced magnet satisfied a required corrosion resistance sufficiently.

Example 3

150 magnet test pieces (having an apparent volume of 0.5 liters and a weight of 1.6 kg) and short columnar aluminum pieces (having an apparent volume of 20 liters and a weight of 100 kg) each having a diameter of 0.8 mm and a length of 1 mm were thrown into a treating chamber in a vibrated-type barrel finishing machine having a volume of 50 liters (so that the total amount was 40% by volume of the internal volume of the treating chamber), where they were treated in a dry manner for 5 hours under conditions of a vibration frequency of 60 Hz and a vibration amplitude of 1.8 mm, thereby forming an aluminum film on the surface of each of the magnets. The formed aluminum film had a thickness of 0.05 μm.

The magnets each having the aluminum film on its surface were dipped in the treating solution described in Example 2 at a bath temperature of 50° C. for 1 minute and 30 seconds and then subjected to a drying treatment at 120° C. for 20 minutes, whereby a zirconium-containing chemical conversion coating film having a thickness of 0.08 μm was formed on the aluminum film. The content of zirconium in the chemical conversion coating film was 16 mg (per 1 $m^2$ of the surface of the magnet); the content of phosphorus was 12 mg (per 1 $m^2$ of the surface of the magnet); the content of oxygen was 38 mg (per 1 $m^2$ of the surface of the magnet), and the content of fluorine was 3 mg (per 1 $m^2$ of the surface of the magnet).

The magnets produced in the above-described manner and each having the zirconium-containing chemical conversion coating film on its surface with the aluminum film interposed therebetween were subjected to the corrosion resistance acceleration test under the same conditions as in Example 1. Results of the test are shown in Table 1. As a result, it was found that the produced magnets satisfied a required corrosion resistance sufficiently.

Example 4

The magnet test piece was cleaned under the same conditions as in Example 1 and then subjected to an arc ion plating process for 2.5 hours, whereby an aluminum film was formed on the surface of the magnet and left to cool. The formed aluminum film had a thickness of 5 μm.

The magnet having the aluminum film on its surface was dipped in the treating solution described in Example 1 at a bath temperature of 40° C. for 1 minute and then subjected to a drying treatment at 100° C. for 20 minutes, whereby a titanium-containing chemical conversion coating film having a thickness of 0.09 μm was formed on the aluminum film. The content of titanium in the chemical conversion coating film was 9 mg (per 1 $m^2$ of the surface of the magnet); the content of phosphorus was 6 mg (per 1 $m^2$ of the surface of the magnet); the content of oxygen was 20 mg (per 1 $m^2$ of the surface of the magnet), and the content of fluorine was 2 mg (per 1 $m^2$ of the surface of the magnet).

The magnet produced in the above-described manner and having the titanium-containing chemical conversion coating film on its surface with the aluminum film interposed therebetween was subjected to a corrosion resistance acceleration test, wherein it was left to stand for 1,000 hours under high-temperature and high-humidity conditions of a temperature of 80° C. and a relative humidity of 90%. The magnetic characteristics before and after the test and the state of variation in appearance after the test are shown in Table 2. As a result, it was found that even if the magnet was left to stand for a long time under the high-temperature and high-humidity conditions, the magnet satisfied a required corrosion resistance sufficiently with both of the magnetic characteristic and appearance little degraded.

Example 5

An aluminum film was formed on the surface of the magnet by an ion plating process for 10 minutes under the same conditions as in Example 2 and then left to cool. The formed aluminum film had a thickness of 10 $\mu$m.

Thereafter, a powder comprising spherical glass beads having an average particle size of 120 $\mu$m and a Mohs hardness of 6 was injected along with a pressurized gas comprising $N_2$ gas against the surface of the aluminum film under an injection pressure of 1.5 kg/cm$^2$ for 5 minutes to carry out the shot peening of the surface of the aluminum film.

The magnet having the aluminum film on its surface was dipped in the treating solution described in Example 2 at a bath temperature of 50° C. for 1 minute and 30 seconds and then subjected to a drying treatment at 120° C. for 20 minutes, whereby a zirconium-containing chemical conversion coating film having a thickness of 0.07 $\mu$m was formed on the aluminum film. The content of zirconium in the chemical conversion coating film was 15 mg (per 1 m$^2$ of the surface of the magnet); the content of phosphorus was 12 mg (per 1 m$^2$ Of the surface of the magnet); the content of oxygen was 47 mg (per 1 m$^2$ of the surface of the magnet), and the content of fluorine was 2 mg (per 1 m$^2$ of the surface of the magnet).

The magnet produced in the above-described manner and having the zirconium-containing chemical conversion coating film on its surface with the aluminum film interposed therebetween was subjected to the corrosion resistance acceleration test under the same conditions as in Example 4. Results of the test are shown in Table 2. As a result, it was found that the produced magnet satisfied a required corrosion resistance sufficiently.

The ratio of the number of moles of phosphorus to the number of moles of zirconium in an area between the surface of the zirconium-containing chemical conversion coating film and a point 0.002 $\mu$m spaced apart from the surface was measured by an X-ray photoelectron spectroscopy (XPS) (using ESCA-850 made by Shimadzu, Co.), and the result showed 7. On the other hand, the ratio of the number of moles of phosphorus to the number of moles of zirconium in the entire chemical conversion coating film was calculated based on the numbers of moles of zirconium and phosphorus measured by a fluorescence X-ray intensity, and as a result, such ratio was 2.

Example 6

The magnet test piece was cleaned under the same conditions as in Example 1. Then, an ingot of metal aluminum used as a coating material was heated and evaporated, and the magnet test piece was subjected to a vacuum evaporation process for 50 minutes under a condition of an argon gas pressure of $1\times10^{-2}$ Pa, thereby forming an aluminum film on the surface of the magnet, and the film was left to cool. The formed aluminum film had a thickness of 8 $\mu$m.

The magnet having the aluminum film on its surface was dipped in the treating solution described in Example 2 at a bath temperature of 50° C. for 1 minute and 30 seconds and then subjected to a drying treatment at 120° C. for 20 minutes, whereby a zirconium-containing chemical conversion coating film having a thickness of 0.06 $\mu$m was formed on the aluminum film. The content of zirconium in the chemical conversion coating film was 15 mg (per 1 m$^2$ of the surface of the magnet); the content of phosphorus was 13 mg (per 1 m of the surface of the magnet); the content of oxygen was 35 mg (per 1 m$^2$ of the surface of the magnet), and the content of fluorine was 2 mg (per 1 m$^2$ of the surface of the magnet).

The magnet produced in the above-described manner and having the zirconium-containing chemical conversion coating film on its surface with the aluminum film interposed therebetween was subjected to the corrosion resistance acceleration test under the same conditions as in Example 4. Results of the test are shown in Table 2. As a result, it was found that the produced magnet satisfied a required corrosion resistance sufficiently.

TABLE 1

| | Before corrosion-resistance test | | | After corrosion-resistance test | | | |
|---|---|---|---|---|---|---|---|
| | Br (kG) | iHc (kOe) | (BH) max (MGOe) | Br (kG) | iHc (kOe) | (BH) max (MGOe) | Appearance after test |
| Example 1 | 11.3 | 16.7 | 30.6 | 11.2 | 16.5 | 29.8 | not varied |
| Example 2 | 11.3 | 16.6 | 30.5 | 11.3 | 16.4 | 29.8 | not varied |
| Example 3 | 11.4 | 16.7 | 30.6 | 11.1 | 16.4 | 29.7 | not varied |
| Com. Example 1 | 11.3 | 16.7 | 30.5 | 10.6 | 15.8 | 27.3 | locally rusted |
| Com. Example 2 | 11.4 | 16.6 | 30.5 | 10.1 | 15.3 | 26.5 | hardly rusted on entire surface |

Com. = Comparative

TABLE 2

| | Before corrosion-resistance test | | | After corrosion-resistance test | | | |
|---|---|---|---|---|---|---|---|
| | Br (kG) | iHc (kOe) | (BH) max (MGOe) | Br (kG) | iHc (kOe) | (BH) max (MGOe) | Appearance after test |
| Example 4 | 11.3 | 16.7 | 30.6 | 11.1 | 16.3 | 29.6 | pin holes produced, but not rusted |
| Example 5 | 11.3 | 16.7 | 30.6 | 11.2 | 16.5 | 29.8 | not varied |
| Example 6 | 11.3 | 16.7 | 30.6 | 11.2 | 16.4 | 29.7 | not varied |
| Com. Example 3 | 11.4 | 16.7 | 30.6 | 10.3 | 15.3 | 27.5 | locally rusted |
| Com. Example 4 | 11.4 | 16.6 | 30.5 | 10.8 | 16.0 | 28.6 | a portion of Ni film peeled off |

Com. = Comparative

Comparative Example 1

The magnet test piece was degreased, pickled and then immersed in a treating solution comprising 4.6 g/l of zinc and 17.8 g/l of phosphate at a bath temperature of 70° C., whereby a phosphate film having a thickness of 1 μm was formed on the surface of the magnet. The produced magnet was subjected to the corrosion resistance acceleration test under the same conditions as in Example 1. Results of the test are shown in Table 1. As a result, the deterioration of the magnetic characteristic was brought about, and the rusting was produced in the produced magnet.

Comparative Example 2

The magnet test piece was subjected to the corrosion resistance acceleration test under the same conditions as in Example 1. Results of the test are shown in Table 1. As a result, the deterioration of the magnetic characteristic was brought about, and the rusting was produced in the magnet test piece.

Comparative Example 3

The magnet having the aluminum film on its surface subjected to the shot peening in Example 5 was subjected to the corrosion resistance acceleration test under the same conditions as in Example 4. Results of the test are shown in Table 2. As a result, the deterioration of the magnetic characteristic was brought about, and the rusting was produced in the produced magnet.

Comparative Example 4

The magnet having the aluminum film on its surface subjected to the shot peening in Example 5 was cleaned and then immersed in a treating solution comprising 300 g/l of sodium hydroxide, 40 g/l of zinc oxide, 1 g/l of ferric chloride and 30 g/l of Rochelle salt at a bath temperature of 23° C., whereby the surface of the aluminum film was substituted with zinc (Zn). Further, the resulting magnet was subjected to an electroplating treatment under a condition of a current density of 1.8 A/dm$^2$ using a plating solution comprising 240 g/l of nickel sulfate, 48 g/l of nickel chloride, an appropriate amount of nickel carbonate (having a pH value adjusted) and 30 g/l of boric acid at a bath temperature of 55° C. and at a pH value of 4.2, whereby a nickel film having a thickness of 0.9 μm was formed on the aluminum film with its surface substituted with zinc. The resulting magnet was subjected to the corrosion resistance acceleration test under the same conditions as in Example 4. Results of the test are shown in Table 2. As a result, the deterioration of the magnetic characteristic of the magnet was brought about, and a portion of the nickel film was peeled off.

INDUSTRIAL APPLICABILITY

In the Fe—B—R based permanent magnet having the chemical conversion coating film which is formed on its surface with the aluminum film interposed therebetween and which contains at least one of zirconium and titanium, phosphorus, oxygen and fluorine as constituting elements, the chemical conversion coating film is adhered firmly to the magnet with the aluminum film interposed therebetween and hence, the magnet is excellent in corrosion resistance. Even if the magnet is left to stand for a long time under high-temperature and high-humidity conditions of a temperature of 80° C. and a relative humidity of 90%, the magnet exhibits a stable high magnetic characteristic which cannot deteriorate. Moreover, the film is free from hexa-valent chromium.

What is claimed is:

1. An Fe—B—R based permanent magnet, which has a chemical conversion coating film formed on its surface with an aluminum film interposed therebetween, said chemical conversion coating film comprising (a) at least one member selected from the group consisting of titanium and zirconium, (b) phosphorus, (c) oxygen and (d) fluorine.

2. An Fe—B—R based permanent magnet according to claim 1, wherein said aluminum film has a thickness in a range of 0.01 μm to 50 μm.

3. An Fe—B—R based permanent magnet according to claim 1, wherein said chemical conversion coating film has a thickness in a range of 0.01 μm to 1 μm.

4. An Fe—B—R based permanent magnet according to claim 1, wherein the content of titanium and/or zirconium in said chemical conversion coating film is in a range of 0.1 mg to 100 mg per a film portion formed on 1 m$^2$ of the surface of the magnet.

5. An Fe—B—R based permanent magnet according to claim 1, wherein the content of phosphorus in said chemical conversion coating film is in a range of 0.1 mg to 100 mg per a film portion formed on 1 m$^2$ of the surface of the magnet.

6. An Fe—B—R based permanent magnet according to claim 1, wherein the content of oxygen in said chemical conversion coating film is in a range of 0.2 mg to 300 mg per a film portion formed on 1 m$^2$ of the surface of the magnet.

7. An Fe—B—R based permanent magnet according to claim 1, wherein the content of fluorine in said chemical conversion coating film is in a range of 0.05 mg to 100 mg per a film portion formed on 1 $m^2$ of the surface of the magnet.

8. An Fe—B—R based permanent magnet according to claim 1, wherein the ratio of the number of moles of phosphorus to the number of moles of titanium and/or zirconium in an area near the surface of the chemical conversion coating film is larger than that in the entire chemical conversion coating film.

9. An Fe—B—R based permanent magnet according to claim 1, wherein the ratio of the number of moles of phosphorus to the number of moles of titanium and/or zirconium in an area near the surface of the chemical conversion coating film is equal to or larger than 1.

10. A process for producing an Fe—B—R based permanent magnet, comprising the steps of forming an aluminum film on the surface of an Fe—B—R based permanent magnet, applying a treating solution comprising (A) at least one member selected from the group consisting of a titanium compound and a zirconium compound, (B) at least one member selected from the group consisting of phosphoric acid, condensed phosphoric acid, phytic acid, the hydrolyzate of phytic acid and their salts, and (D) a fluorine compound, onto the surface of the aluminum film, and drying the applied treating solution, thereby forming a chemical conversion coating film comprising (a) at least one member selected from the group consisting of titanium and zirconium, (b) phosphorus, (c) oxygen and (d) fluorine.

11. A process for producing an Fe—B—R based permanent magnet according to claim 10, wherein said aluminum film is formed by a vapor deposition process.

12. A process for producing an Fe—B—R based permanent magnet according to claim 11, wherein said aluminum film has a thickness in a range of 0.01 $\mu$m to 50 $\mu$m.

13. A process for producing an Fe—B—R based permanent magnet according to claim 10, wherein the Fe—B—R based permanent magnet and aluminum pieces are placed into a treating vessel, where they are vibrated and/or agitated, thereby forming the aluminum film.

14. A process for producing an Fe—B—R based permanent magnet according to claim 13, wherein said aluminum film has a thickness in a range of 0.01 $\mu$m to 1 $\mu$m.

15. A process for producing an Fe—B—R based permanent magnet according to claim 10, wherein the ratio of the number of moles (in terms of phosphorus) of said at least one member selected from the group consisting of phosphoric acid, condensed phosphoric acid, phytic acid, the hydrolyzate of phytic acid and their salts to the number of moles (in terms of metal) of said at least one member selected from the group consisting of the titanium compound and the zirconium compound in the treating solution is equal to or larger than 1.

* * * * *